US005496251A

United States Patent [19]

Cheng

[11] Patent Number: 5,496,251

[45] Date of Patent: Mar. 5, 1996

[54] METHOD AND APPARATUS FOR MANUFACTURING A SHELL-SHAPED PACKAGE, AND SUCH SHELL-SHAPED PACKAGE

[75] Inventor: Sheng C. Cheng, Kaohsiung, Taiwan

[73] Assignee: Jei Lee Corporation, Taiwan

[21] Appl. No.: 170,122

[22] Filed: Dec. 20, 1993

[30] Foreign Application Priority Data

Sep. 6, 1993 [NL] Netherlands ..... 9301532

[51] Int. Cl.[6] ..... B31B 25/00; B31B 1/16

[52] U.S. Cl. ..... 493/224; 493/196; 493/204; 493/342; 493/346

[58] Field of Search ..... 493/194, 195, 493/196, 203, 204, 223, 224, 297, 346, 342; 83/27, 103

[56] References Cited

U.S. PATENT DOCUMENTS

| | | | |
|---|---|---|---|
| 3,172,796 | 3/1965 | Gulker | 493/196 |
| 3,860,115 | 1/1975 | Laske | 493/203 |
| 5,228,234 | 7/1993 | de Klerk et al. | 47/41.01 |

FOREIGN PATENT DOCUMENTS

| | | |
|---|---|---|
| 0369549 | 5/1990 | European Pat. Off. . |
| 0063251 | 10/1992 | European Pat. Off. . |
| 2501691 | 7/1976 | Germany . |

*Primary Examiner*—Jack W. Lavinder
*Attorney, Agent, or Firm*—Peter L. Michaelson

[57] ABSTRACT

The invention relates to a method of manufacturing shell-shaped packages, in particular flower sleeves, in which two superposed bands of synthetic material are supplied and machined through die cutting, in such a manner that at least one edge of each package, defining the wide opening, is formed along an ornamental line, whereafter the material bands are cut in transverse direction into separate package portions, the discrete package portions being joined together at the cut edges so as to form the package, wherein, during the die cutting of the longitudinal edges of the material bands, both material bands are perforated through and through in one die cutting operation so as to form suspension portions joined to the package portions via perforated lines extending along an ornamental contour, the suspension portion, formed by the perforation, of one of the two material bands being removed. The invention further relates to an apparatus for carrying out the method, and to the package obtained by the method.

4 Claims, 3 Drawing Sheets

METHOD AND APPARATUS FOR MANUFACTURING A SHELL-SHAPED PACKAGE, AND SUCH SHELL-SHAPED PACKAGE

BACKGROUND OF THE INVENTION

This invention relates to a method and accompanying apparatus for manufacturing a shell-shaped package, and a resulting package formed thereby.

A prior art method for manufacturing a shell-shaped package is disclosed in European patent specification 0 369 549.

The drawback of the prior art method is that the material bands, before the longitudinal edges thereof are machined, must be separated by means of a separating element, such as for instance a plate or board, in connection with the fact that the edges of the packages that define the wide opening are to be machined in different manners so as to obtain a package that is simple to open.

Another disadvantage of the prior art method is that two pairs of cutting dies are necessary to machine the material bands, viz. one pair on one side of the separating element and one pair on the other side of the separating element. Such cutting dies are subject to wear, so that they must be replaced regularly, which is particularly costly.

Prior art apparatus for manufacturing a shell-shaped package is disclosed in European patent specification 0 369 549. The prior art apparatus comprises a separating element and four cutting and/or perforating dies, viz. one pair on each surface side of the plate-shaped separating element. The prior art apparatus is very costly owing to the presence of the separating plate, the two pairs of cutting dies and the two displacement mechanisms associated with the cutting dies.

A prior art shell-shaped package, too, is disclosed in European patent specification 0 369 549. The drawback of the prior art package resides in the fact that it can only be manufactured with much effort because one wide opening side of the package projects relative to the other wide opening edge. In the prior art package, one of the package portions comprises a suspension portion which is connected to the relevant package portion via a perforated line.

SUMMARY OF THE INVENTION

One object of the present inventive method is to provide a simple and hence economically practicable method of manufacturing shell-shaped packages tapering from a wide opening, these packages, at the wide opening thereof, being provided with edges following an ornamental contour and these wide opening edges being readily openable.

The method of the present invention provides the advantage that half the required number of punches or perforators suffice and that, moreover, the separation of the material bands during the manufacture of the shell-shaped packages can be omitted. In spite of the fact that the present method can be practiced with simpler means, and hence at considerably lower cost, the package obtained yet has the advantage that it can be readily opened by the user, just like the package disclosed in European patent specification 0 369 549. The present invention is based on the insight that for the package to be easy to open, it is not required that the opening edge of one package portion project relative to the opening edge of the other package portion; that, however, for the package to be easy to open, it is sufficient for the package portions to project relative to each other at the opening edges, which themselves may be in alignment. Such is the case in the package obtained by the method of the invention by virtue of the feature that the suspension portion of one package portion of the shell-shaped package is removed. Although the wide opening edges of the package obtained by the method of the invention are in alignment, the edges of the package portions do project relative to each other at the opening edges, so that the package can be readily opened.

Another object of the present invention is to provide an apparatus without the above-mentioned drawbacks associated with the prior art, which enables the manufacture of shell-shaped packages that exhibit the same good properties as does the packages disclosed in European patent specification 0 369 549.

Because the inventive apparatus comprises only one pair of cutting dies which are adapted for perforating both material bands in a single machining operation, the use of the separating plate can be omitted and moreover only one displacement mechanism is required for moving the cutting dies up and down. Accordingly, the present apparatus is much less costly than the prior art apparatus and moreover the use of the apparatus is significantly cheaper since only one pair of cutting dies are subject to wear, so that whenever replacement is necessary only one pair of cutting dies needs to be replaced.

It has been found that the inventive package can also be opened in very simple manner. Moreover, such a package exhibits the advantage that it can be manufactured in a simpler and hence cheaper manner.

BRIEF DESCRIPTION OF THE DRAWINGS

Further elaborations of the method, apparatus and package according to the present invention are described below and will be further clarified on the basis of some exemplary embodiments, with reference to the accompanying drawings.

DETAILED DESCRIPTION

Figure 1:
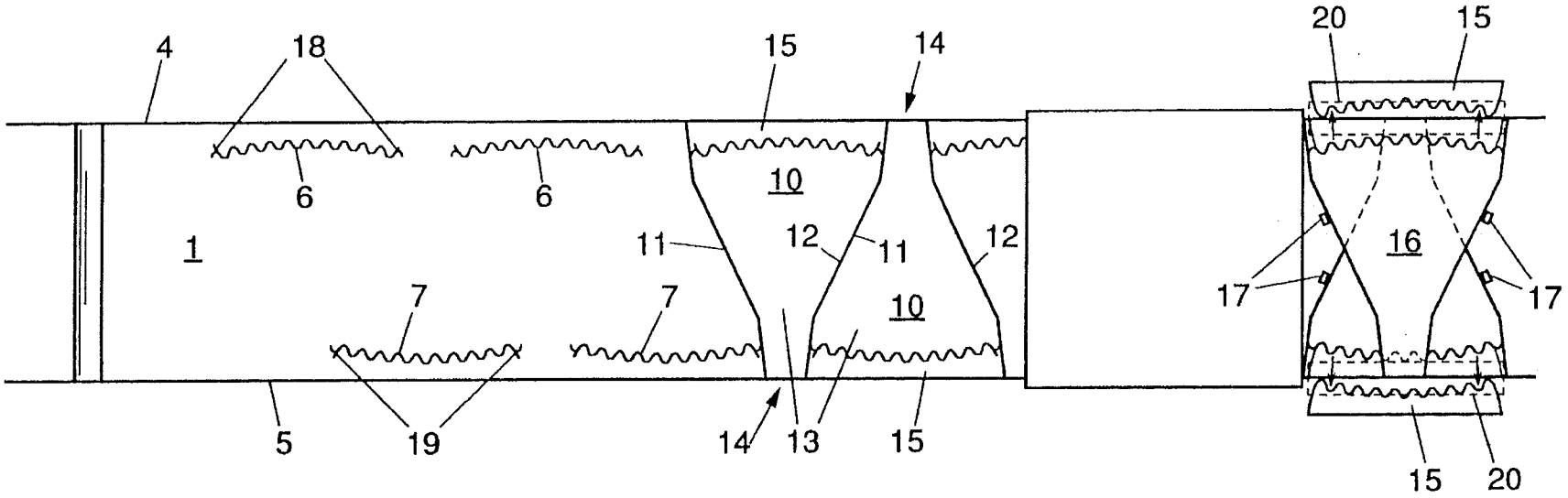
FIG. 1 shows a top plan view of the material bands and, in succession, the different operations these bands undergo in the method of the present invention.

FIG. 1 shows a top plan view of the material bands, indicating the different machining operations. To facilitate understanding, the reader should simultaneously refer to FIGS. 2 and 3 throughout the following discussion. In a single machining operation, using one pair of perforating dies 2, 3, capable of being moved up and down, the superposed synthetic material bands 1, 1*a* at the two longitudinal edges 4, 5 thereof, are both provided pairwise with perforated lines 6, 7 following an ornamental contour. Then the material bands 1, 1*a* are separated into separate package portions by means of heated cutting dies 8, 9 extending substantially transversely to the longitudinal direction of the material bands 1, 1*a*. The superposed package portions 10, 10*a* originating from two material bands 1, 1*a* are thereupon interconnected at the cut edges 11, 12 as formed by the heated cutting dies. Inasmuch as band 1*a*, and portions 10*a* and 15*a* lie directly underneath and in exact registration with bank 1, and portions 10 and 15, respectively, the former elements (1*a*, 10*a* and 15*a*) are all not specifically illustrated in the drawings.

Figure 2:
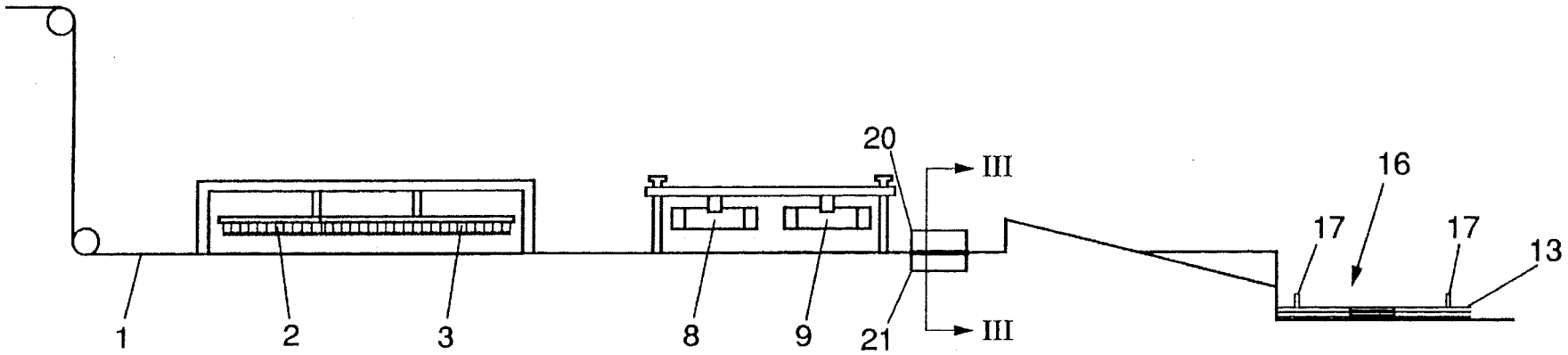
FIG. 2 shows a side elevation of an exemplary embodiment of the apparatus by means of which the different method steps can be carried out.

Thus, a package 13 is obtained, tapering from a wide opening edge 6 or 7, formed by the perforated line, to a narrow end 14. Connected to the package portions 10, 10*a* via the perforated lines 6 or 7 are suspension portions 15, by which the package can be suspended in simple manner. As the perforated lines 6 or 7 of the package portions 10, 10*a* are in alignment since they were formed simultaneously by the same perforating die 2 or 3, the above-described package, comprising two suspension portions 15, 15*a* (situated one atop the other) would not be readily openable. In order to remove this problem, one (e.g. the top) of the suspension portions 15, 15*a* is removed from the package. In FIGS. 1 and 2 such removal takes place at the time when a package is being added to a stack 16 to be formed from the packages, this stack being formed between aligning means 17. It is, of course, also possible for the removal of one of the suspension portions 15 to take place after the provision of the perforated lines 6, 7 and before the material bands 1, 1*a* are die cut into discrete package portions 10, 10*a*.

Figure 3:
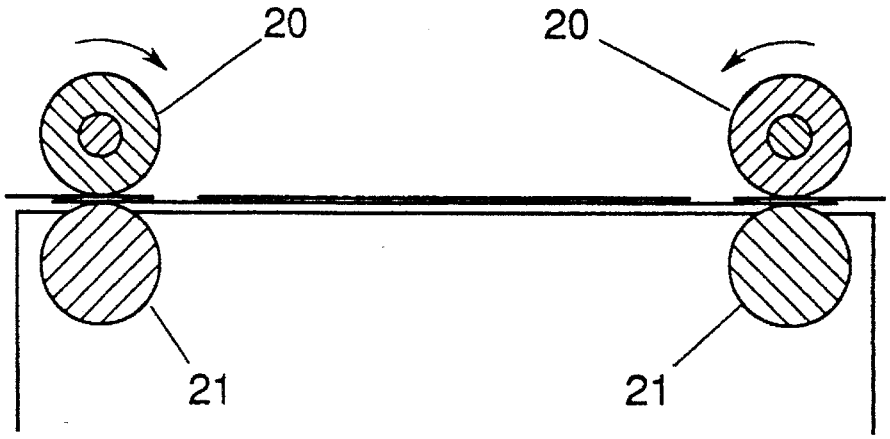
FIG. 3 shows a sectional view taken on line III—III of FIG. 2.

In an advantageous embodiment, the perforating dies 2, 3, which can optionally be heated to facilitate the machining of material that is hard to process, further comprise additional cutting or perforating portions (not shown) for forming cut or perforated lines 18, 19. The cut or perforated lines 18, 19 form a tear initiating zone for removing suspension portion 15. The cut or perforated lines 18, 19, serving as tear initiating zones, preferably extend in the direction of the free edges of the suspension portion 15. Owing to the presence of the tear initiating zone, the removal of the suspension portion 15 to be removed can be effected through tearing. The removal of the suspension portion 15 can for instance be effected by hand. However, it is preferred that the apparatus for manufacturing the package be provided with special means for this purpose. FIG. 3 shows a possible embodiment of such means, wherein rotary friction rollers 20 engage the suspension portion 15 to be removed and pull the suspension portion 15 off the remaining package portion 10 in a direction transverse to the longitudinal direction of the material bands. The suspension portion 15*a* connected with the other package portion 10*a* must remain attached and for that purpose abuts a stationary friction element 21, such as, for instance, a plate or stationary rollers 21 with a high coefficient of friction.

Figure 4:
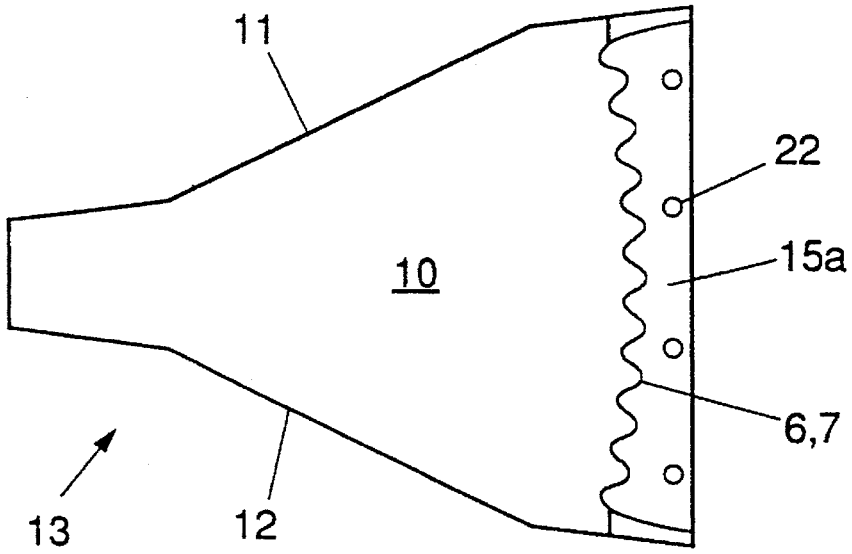
FIG. 4 shows a top plan view of an exemplary embodiment of a shell-shaped package, such as for instance a flower sleeve, according to the invention.

The package obtained by the method of the invention is shown in FIG. 4. The packages have been collected into a stack 16 and connected at the suspension portions 15*a*, for instance through stapling or a weld obtained by piercing the suspension portions 15*a* with a hot welding pin (not shown). The apertures 22 have been formed by such a hot welding pin. Further, FIG. 3 clearly indicates that the opening edges, formed by the perforated lines 6 or 7 and following an ornamental contour, are in alignment.

It is understood that the present invention is not limited to the exemplary embodiment described but various modifications are possible without departing from the scope of the invention.

I claim:

1. A method of manufacturing shell-shaped packages, each of said packages tapering from a wide opening to a narrow end, the method comprising the steps of:

simultaneously supplying two bands of synthetic material of substantially the same width in a longitudinally superposed fashion so as to form superposed material bands;

in one perforating operation performed from one material band surface side and in a substantially longitudinal direction, perforating completely through both of said superposed material bands in such a manner that at least one edge defining the wide opening is formed along an ornamental line in each of said material bands, so as to form superposed perforated ornamental lines and two separate superposed suspension portions, each one of the perforated ornamental lines extending substantially throughout a length of the wide opening;

cutting said superposed material bands in a transverse direction, across the width of said superposed bands, into separate superposed package portions, having superposed cut edges thereof, such that wide openings of successive shell-shaped packages are located proximate to alternately opposite longitudinal edges of the superposed material bands, and joining the superposed package portions together along the superposed cut edges thereof, wherein the separate superposed package portions are connected to each other along the superposed cut edges so as to form a corresponding one of the shell-shaped packages and wherein each of said suspension portions is connected, along a corresponding one of the ornamental lines, to a corresponding one of the superposed package portions and extends to a corresponding proximate one of the longitudinal edges of the superimposed material bands; and removing one of the suspension portions from each one of the shell-shaped packages.

2. The method of claim 1 wherein the one suspension portions removing step occurs prior to the occurrence of the cutting and joining steps.

3. The method of claim 1 wherein the one suspension portions removing step occurs subsequent to the occurrence of the cutting and joining steps.

4. The method of claim 1 further comprising the step of, during the one perforating operation, providing a perforated line in each of the superposed suspension portions so as to form a tear initiating zone in each of the superposed suspension portions.

* * * * *